US008872673B2

(12) United States Patent
Colburn, III

(10) Patent No.: US 8,872,673 B2
(45) Date of Patent: Oct. 28, 2014

(54) VEHICLE-INTEGRATED AUTOMATIC IDENTIFICATION APPARATUS

(76) Inventor: Philmore H. Colburn, III, Longmeadow, MA (US)

( * ) Notice: Subject to any disclaimer, the term of this patent is extended or adjusted under 35 U.S.C. 154(b) by 256 days.

(21) Appl. No.: 13/407,078

(22) Filed: Feb. 28, 2012

(65) Prior Publication Data

US 2013/0222156 A1 Aug. 29, 2013

(51) Int. Cl.
*G08G 1/00* (2006.01)

(52) U.S. Cl.
USPC ..... 340/928; 235/384; 701/117; 705/13

(58) Field of Classification Search
CPC . G06K 19/07758; G06Q 20/32; G07B 15/00; G07B 15/06; G07B 15/063; G07C 5/008; G08G 1/00; G08G 1/017
USPC ..... 235/384; 340/10.1, 572.1, 928, 933; 342/32, 37, 42, 45; 455/41.2; 701/117, 701/120, 301; 705/13
See application file for complete search history.

(56) References Cited

U.S. PATENT DOCUMENTS

| | | | | |
|---|---|---|---|---|
| 4,152,647 | A * | 5/1979 | Gladden et al. | 455/11.1 |
| 4,861,971 | A * | 8/1989 | Chan | 235/384 |
| 5,600,333 | A * | 2/1997 | Justice et al. | 343/713 |
| 5,694,298 | A * | 12/1997 | Chabert et al. | 361/798 |
| 5,798,688 | A * | 8/1998 | Schofield | 340/438 |
| 6,229,492 | B1 * | 5/2001 | Lee et al. | 343/713 |
| 6,339,384 | B1 * | 1/2002 | Valdes-Rodriguez | 340/928 |
| 6,431,712 | B1 * | 8/2002 | Turnbull | 359/604 |
| 6,690,293 | B2 * | 2/2004 | Amita | 340/928 |
| 6,832,719 | B2 * | 12/2004 | DeVries et al. | 235/380 |
| 6,909,876 | B2 * | 6/2005 | Higashino et al. | 455/41.2 |
| 7,649,503 | B2 * | 1/2010 | Heo | 343/713 |
| 8,132,724 | B2 * | 3/2012 | Hayashi | 235/382 |
| 8,749,366 | B2 * | 6/2014 | Hwang et al. | 340/438 |
| 2002/0158805 | A1 * | 10/2002 | Turnbull et al. | 343/713 |
| 2003/0107521 | A1 * | 6/2003 | Matsuura et al. | 343/713 |
| 2004/0121820 | A1 * | 6/2004 | Unno et al. | 455/569.2 |
| 2004/0249526 | A1 * | 12/2004 | Hauer et al. | 701/29 |
| 2006/0255967 | A1 * | 11/2006 | Woo et al. | 340/928 |
| 2006/0255968 | A1 * | 11/2006 | Woo et al. | 340/928 |
| 2008/0090446 | A1 * | 4/2008 | Lamont et al. | 439/351 |
| 2008/0204278 | A1 * | 8/2008 | Tsuzuki et al. | 340/928 |
| 2010/0145776 | A1 * | 6/2010 | Eguchi et al. | 705/13 |
| 2010/0148920 | A1 * | 6/2010 | Philmon et al. | 340/5.2 |

FOREIGN PATENT DOCUMENTS

JP 2003150994 A * 5/2003 ..... G07B 15/00

* cited by examiner

*Primary Examiner* — Benjamin C Lee
*Assistant Examiner* — Stephen Burgdorf
(74) *Attorney, Agent, or Firm* — Cantor Colburn LLP

(57) ABSTRACT

An automatic identification apparatus includes a control module configured as an integrated component of a vehicle and an electrical power interface receptive to a power signal from the vehicle. The electrical power interface provides electrical power to the control module. The automatic identification apparatus also includes an antenna electrically connected to the control module. The antenna transmits a radio wave indicative of a unique identification. The antenna is configured as an integrated component of the vehicle and is located to communicate the radio wave external of the vehicle. The automatic identification apparatus further includes a memory interface assembly configured as an integrated component of the vehicle. The memory interface assembly is receptive to a memory device encoded with the unique identification. The memory interface assembly communicates the unique identification to the control module when the memory device is received in the memory interface assembly.

3 Claims, 5 Drawing Sheets

VEHICLE-INTEGRATED AUTOMATIC IDENTIFICATION APPARATUS

BACKGROUND

The present invention relates to radio frequency-based identification and, more specifically, to vehicle-integrated automatic identification using radio frequency transmission.

Electronic toll collection systems seek to reduce the wait time for vehicles travelling on toll roads by providing access to dedicated travel lanes for subscribers who pay a use fee for this access. A toll collection service provider supplies subscribers with transponder units that utilize radio frequency identification (RFID) technology to communicate with RFID reader devices installed at dedicated travel lanes.

A conventional transponder unit is approximately the size of a deck of cards and is typically mailed to a user upon subscribing to an electronic toll collection service. Once received, the subscriber is provided with instructions to secure the transponder unit to an upper portion of a driver-side front windshield using adhesive tape and fastening material, such as Velcro™. Due to its size and relative placement on the vehicle's front windshield, the transponder unit is not only obstructive to the vehicle operator's view, but it is unsightly as well.

As an alternative, some subscribers choose to leave the transponder unit unanchored on the dashboard of the vehicle; however, the extra distance created between the unit's location on the dashboard (as compared to the intended installation on an upper driver-side front windshield) and the reader device at the toll collection system's dedicated travel lane may effectively cast the unit out of communicative range of the reader device, thereby rendering the unit inoperative. Furthermore, unless the transponder unit is removed from the dashboard before and after its immediate use, the unit tends to slide back and forth along the length of the dashboard while the vehicle is in operation or is thrust from the dashboard onto the seat or floor of the vehicle.

Regardless of whether the transponder unit is affixed to the vehicle windshield or is placed freestanding on the vehicle dashboard, the unit remains highly visible to passersby, thereby rendering it subject to theft. While the fastening material provided with the unit enables removal and portability of the transponder unit between vehicles, the same issues of safety, unsightliness, and unwanted visibility remain.

Conventional transponders are manufactured as disposable units with a limited lifespan that generally corresponds with the life of their internal batteries. As shown in FIG. 1, a conventional transponder 100 includes various elements, such as a control module 106, an antenna 110, a memory device 104, and a battery 108 that are each communicatively coupled to one another via wiring. These elements are accommodated within a sealed housing 102, such that they are non-removable and non-replaceable by their subscribing end users. Thus, when the battery 108 of the unit loses power or the device otherwise breaks down, the end user must acquire a new transponder from an electronic toll collection service provider.

SUMMARY

According to one embodiment of the present invention, an automatic identification apparatus is provided. The automatic identification apparatus includes a control module configured as an integrated component of a vehicle, and an electrical power interface receptive to an electrical power signal provided from the vehicle. The electrical power interface is electrically connected to the control module to provide electrical power thereto. The electrical power interface is configured as an integrated component of the vehicle. The automatic identification apparatus also includes a radio frequency identification antenna electrically connected to the control module. The radio frequency identification antenna is responsive to the control module for transmitting a radio wave indicative of a unique identification. The radio frequency identification antenna is configured as an integrated component of the vehicle and is located to communicate the radio wave external of the vehicle. The automatic identification apparatus further includes a memory interface assembly configured as an integrated component of the vehicle. The memory interface assembly is receptive to a memory device encoded with the unique identification. The memory interface assembly is electrically connected to the control module for communicating the unique identification from the memory device when the memory device is received in the memory interface assembly to the control module.

According to another embodiment of the present invention, a rear-view mirror assembly is provided. The rear-view mirror assembly includes a mirror housing, a mirror element disposed within a surface opening in the minor housing, and a mounting structure that secures the minor housing to a vehicle. The rear-view minor assembly also includes an automatic identification apparatus that is integrally formed with one of the mirror housing and the mounting structure. The automatic identification apparatus includes a mirror housing, a mirror element disposed within a surface opening in the mirror housing, a mounting structure configured to secure the minor housing to a vehicle, and an automatic identification apparatus integrally formed with the minor housing. The automatic identification apparatus includes a control module, and an electrical power interface receptive to an electrical power signal provided from the vehicle. The electrical power interface is electrically connected to the control module to provide electrical power thereto. The automatic identification apparatus also includes a radio frequency identification antenna electrically connected to the control module. The radio frequency identification antenna responsive to the control module transmits a radio wave indicative of a unique identification. The radio frequency identification antenna is located to communicate the radio wave external of the vehicle. The automatic identification apparatus further includes a memory interface assembly receptive to a memory device encoded with the unique identification. The memory interface assembly is electrically connected to the control module for communicating the unique identification from the memory device when the memory device is received in the memory interface assembly to the control module.

According to a further embodiment of the present invention, an automatic identification apparatus is provided. The automatic identification apparatus includes a control module configured as an integrated component of a vehicle, and an electrical power interface receptive to an electrical power signal provided from the vehicle. The electrical power interface is electrically connected to the control module to provide electrical power thereto. The electrical power interface is configured as an integrated component of the vehicle. The automatic identification apparatus also includes a radio frequency identification antenna electrically connected to the control module. The radio frequency identification antenna responsive to the control module transmits a radio wave indicative of a unique identification. The radio frequency identification antenna is configured as an integrated component of the vehicle and located to communicate the radio wave external of the vehicle. The automatic identification apparatus further includes a wireless adapter communicatively coupled to the control module. The wireless adapter is configured to receive the unique identification over a wireless network and communicate the unique identification to the control module.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

An exemplary integrated automatic identification apparatus and a rear-view mirror assembly incorporating the same are provided. The integrated automatic identification apparatus (also referred to herein as "integrated vehicle transponder") enables subscribers of electronic toll collection services to access dedicated toll lanes without the requirement of bulky transponder units which, due to their size and placement on a windshield or dashboard of a vehicle, can be unsafe and unsightly. The exemplary integrated automatic identification apparatus is integrated with a vehicle, e.g., either during manufacture of the vehicle or as an aftermarket event, and is coupled to a power source that is internal to the vehicle, thereby eliminating the need for a separate battery which effectively increases its lifespan. The integration of the apparatus in the vehicle results in a visually discreet structure that is not easily detectable by individuals outside of the vehicle, thereby impeding theft of the apparatus. These and other features of the exemplary integrated automatic identification apparatus will now be described.

Figure 4:
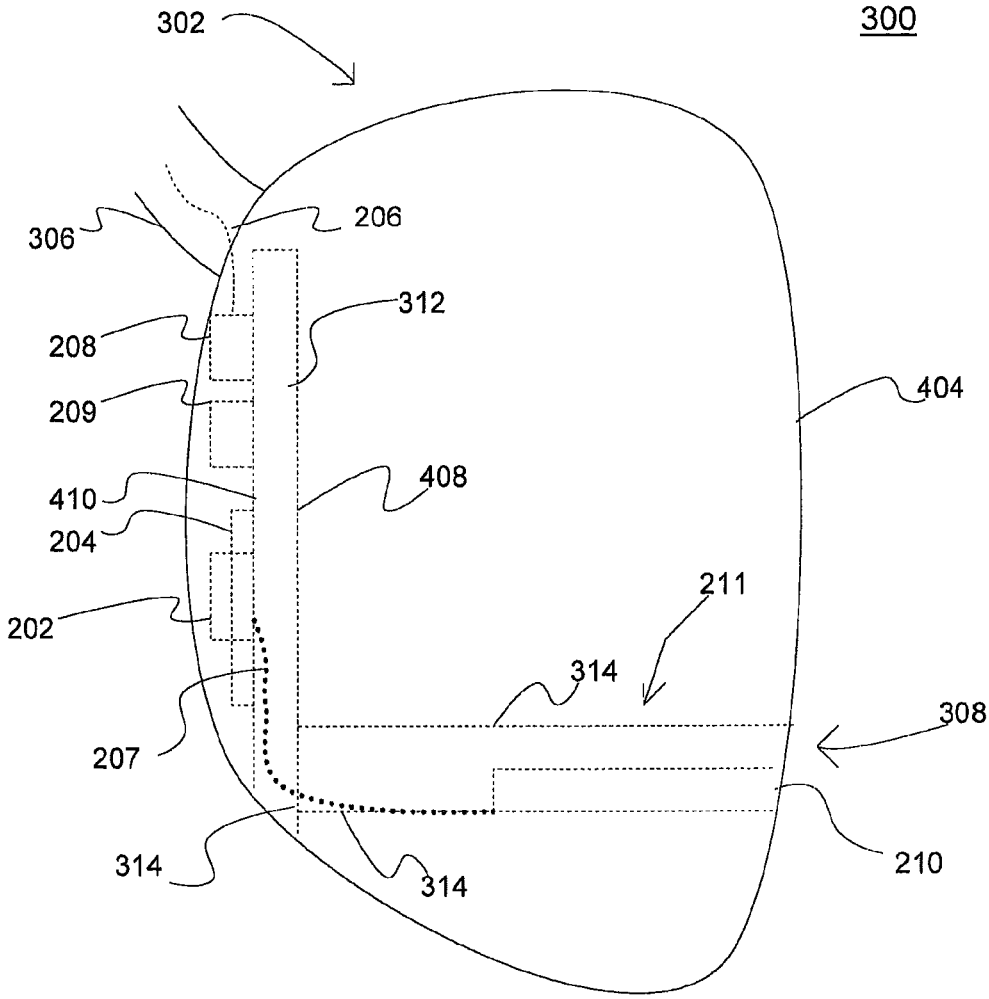
FIG. 4 depicts a side view of the exemplary rear-view mirror assembly of FIG. 3.
Figure 5:
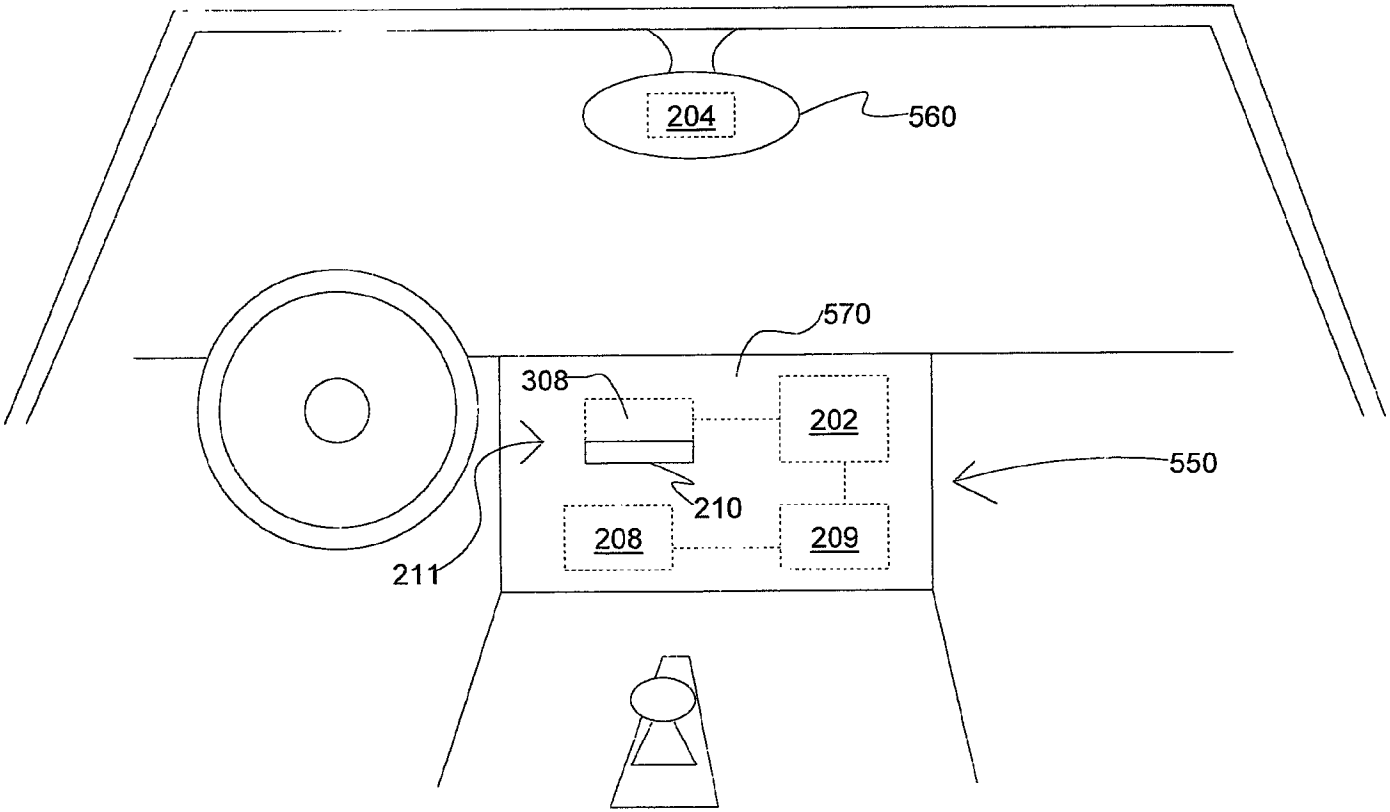
FIG. 5 depicts a plan view of an exemplary vehicle console.

While the exemplary integrated automatic identification apparatus may be disposed anywhere in the vehicle that is capable of communicating with a radio frequency identification (RFID) reader device (i.e., any area of the vehicle within communicative range of the RFID reader device), exemplary embodiments are described herein with respect to a rear-view mirror assembly (shown in FIGS. 3 and 4), and a vehicle console (shown in FIG. 5).

Figure 1:
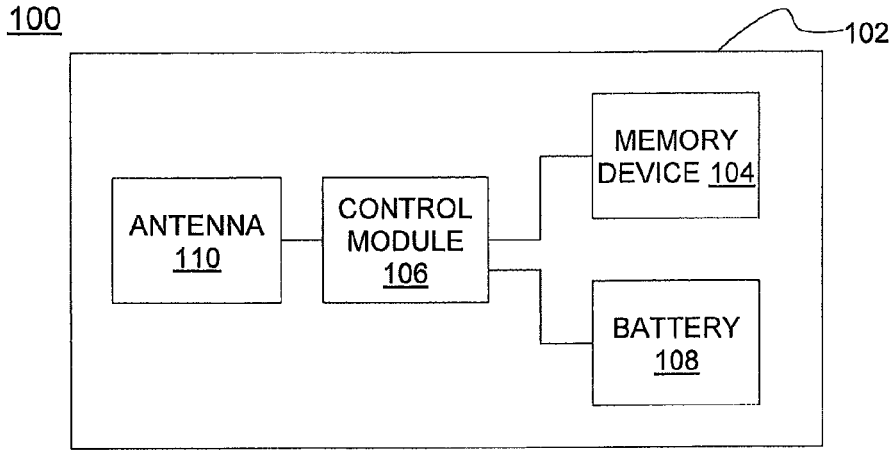
FIG. 1 (PRIOR ART)
FIG. 1 depicts a block diagram of a conventional vehicle transponder.
Figure 2:
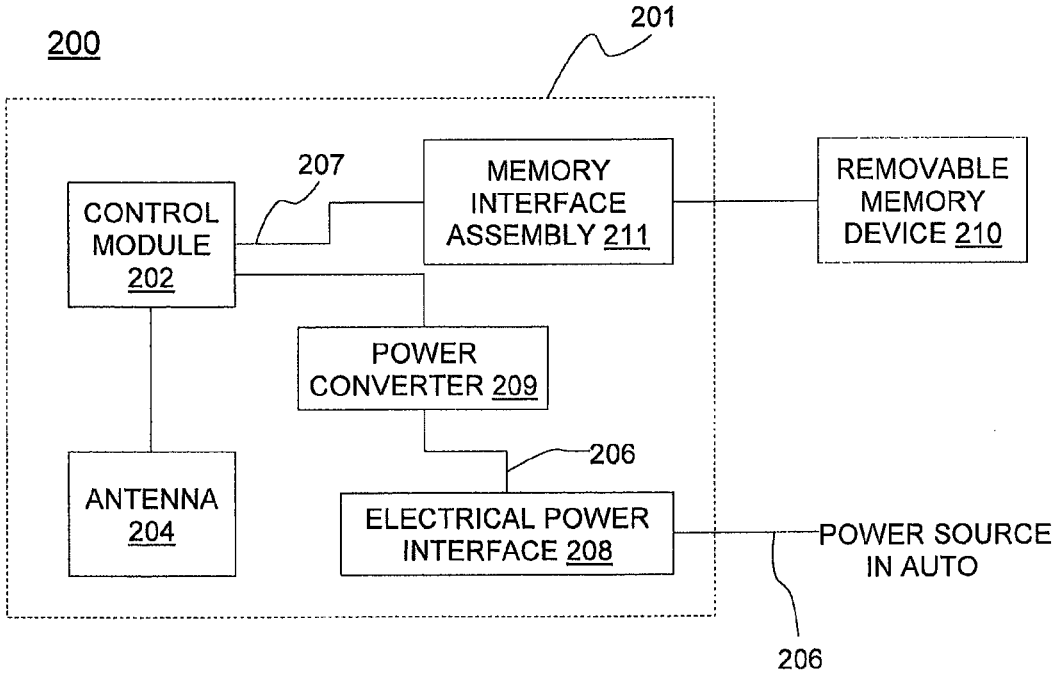
FIG. 2 depicts a block diagram of an exemplary integrated automatic identification apparatus.

Referring now to FIG. 2, an exemplary integrated vehicle transponder for use in electronic toll collection is generally shown at 200. The integration of the transponder elements into the vehicle, as described more fully below, is an important feature of the present invention. The integrated vehicle transponder includes a control module 202 and an antenna 204. The control module 202 may be of the same type presently found in the above-described prior art discrete transponders. For example, the control module 202 includes a processor or logic controller, a modulator, a demodulator, a receiver, a transmitter, and a ground unit. The antenna 204 may be a ferrite core antenna or any suitable antenna used in radio frequency transmissions.

A communications component, such as an electrical wire 206 carrying power from the vehicle is connected through an electrical power interface 208 and a power converter 209 to the control module 202 for powering the same. In cases where the power from the vehicle is at the proper voltage for powering the control module 202, the power converter 209 may be omitted. This departs from the prior art discrete transponders, which have an internal battery for providing power. Proving vehicle power to the integrated vehicle transponder, rather than relying on a separate battery, alleviates any concerns of the battery dying, which would require replacement of the prior art discrete transponder itself.

The electrical power interface 208 may be implemented as an electro-mechanical device configured to join one or more electrical circuits between the control module 202 (or power converter 209) and the vehicle's power source.

The integrated vehicle transponder of FIG. 2 also includes a memory interface assembly 211, which is communicatively coupled via wiring 207 to the control module 202. The memory interface assembly 211 is configured to receive a removable memory device 210 and is described further herein.

The removable memory device 210 includes memory for storing subscriber identification information. The subscriber identification information is unique to each subscriber and defines the information transmitted by the control module 202 through the antenna 204. The removable memory device 210 may be similar in structure to a subscriber identity module (SIM) card such as commonly found in cellular telephones (e.g., as defined by ISO/IEC 7810, an international organization that defines standards for the physical characteristics used in identification cards), although other removable programmed memory microchips may be employed without departing from the spirit or scope of the present invention.

The removable memory device 210 serves the same function as the permanently installed memory of the prior art discrete transponders, i.e., storing subscriber identification information. The use of the removable memory device 210 allows the regulating authority of the electronic toll collection service provider to continue to control and assign subscriber identification information without having to provide the entire transponder unit. The regulating authority can simply provide to its subscribers (typically via shipping) the removable memory device 210, which may be the size of a SIM card as compared to the bulkier conventional transponder units, thereby resulting in a substantial reduction in cost to the regulating authority in terms of shipping costs incurred.

Portions of the exemplary integrated vehicle transponder, i.e., the control module 202, antenna 204, electrical power interface 208, the power converter 209 (if applicable), and the memory interface assembly 211, are integrally formed with the vehicle, which portions are shown generally at 201 in FIG. 2. The control module 202, antenna 204, electrical power interface 208, power converter 209, memory interface assembly 211, and any corresponding circuitry may be formed directly on a component of a vehicle, such that the location of the antenna 204 is within communicative range of a RFID reader device. Alternatively, the integrated vehicle transponder components may be applied or affixed to a base structure or material (shown in FIGS. 3 and 4), which is then integrated within the vehicle as a single unit using any form of fixing elements, e.g., screws, adhesive, etc. The antenna 204 may be implemented using wire or may be printed on the substrate using conductive ink.

As indicated above, the exemplary integrated vehicle transponder may be disposed anywhere in the vehicle that is capable of communicating with a RFID reader device. Exemplary embodiments are provided herein with respect to a rear-view mirror assembly and vehicle console, as will now be described.

Figure 3:
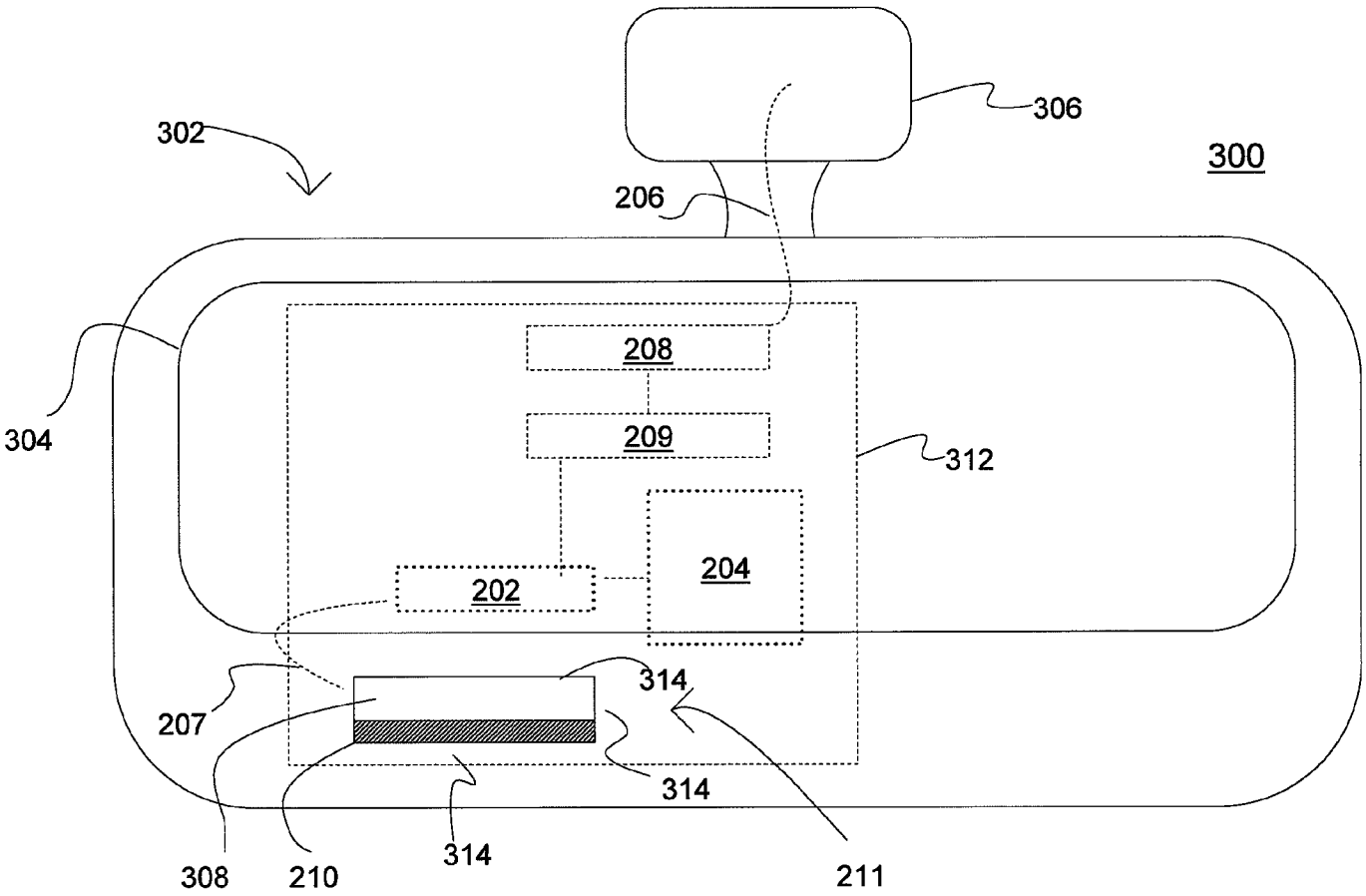
FIG. 3 depicts a plan view of an exemplary rear-view mirror assembly.

FIG. 3 illustrates a plan view of an exemplary rear-view mirror assembly 300, FIG. 4 illustrates a side view of the exemplary rear-view minor assembly 300 of FIG. 3, and FIG. 5 illustrates a plan view of an exemplary vehicle console.

The rear-view minor assembly 300 includes a mirror housing 302 and a mirror element 304 that is disposed within a surface opening in the minor housing 302. The rear-view mirror assembly 300 also includes a mounting structure 306 configured to secure the mirror housing 302 to a front windshield (not shown) or frame of a vehicle. The minor housing 302 incorporates the integrated vehicle transponder shown in FIG. 2.

As shown in FIGS. 3 and 4, the memory interface assembly 211 is disposed in a lower portion of the mirror housing 302 in an area that does not interfere with the operation of the mirror element 304. The memory interface assembly 211 may be implemented using a variety of techniques. As shown in FIGS. 3 and 4, the memory interface assembly 211 includes a housing formed by sidewalls 314 and an opening 308 or slot formed therein. Alternatively, the receiving arrangement may include a housing formed by a plurality of sidewalls and an opening configured to receive a drawer having a compartment in which the removable memory device 210 is placed (not shown).

The opening 308 of the memory interface assembly 211 is visible on a cabin-facing surface 404 of the mirror housing 302. The memory interface assembly 211 is affixed to, or formed integral with, at least a portion of the minor housing 302. It will be understood that the memory interface assembly 211 of the integrated vehicle transponder may be attached at any location in the minor housing 302 using any fixing means, such as adhesive material or screws.

The memory interface assembly 211 may also include a fixing element (not shown) configured to frictionally engage the removable memory device 210 in the housing. For example, the fixing element may be a detent. The alternative receiving arrangement described above, which includes the drawer, may also include a fixing element configured to frictionally engage the drawer in the housing.

The memory interface assembly 211 may be manufactured to have a size commensurate with the minimum requirements needed to house the removable memory device 210.

As shown in FIGS. 3 and 4, the control module 202, antenna 204, electrical power interface 208, power converter 209, and memory interface assembly 211 are disposed on a substrate 312. The antenna 204 is disposed on a surface 410 of the substrate 312 facing away from the vehicle cabin in order to provide increased communication capabilities with a RFID reader device. At least a portion of the rear-view mirror assembly 300 includes non-metallic material, in order to provide a communication pathway between the antenna 204 of the integrated vehicle transponder and a RFID reader device installed at a dedicated travel lane. Alternatively, the antenna 204 may be disposed at the mounting structure 306. As shown in FIG. 4 for illustrative purposes, each of the control module 202, antenna 204, electrical power interface 208, power converter 209, and memory interface assembly 211, along with corresponding circuitry, is disposed on the surface 410 of the substrate 312 that faces away from the vehicle cabin. The wire 206, which couples the integrated vehicle transponder to the vehicle's power source, runs from the electrical power interface 208 and power converter 209 through the mounting structure 306 to the vehicle's power supply.

The substrate 312 is formed integrally with the memory interface assembly 211, and a wire 207 communicatively couples the control module 202 on the substrate 312 to the memory interface assembly 211, as well as the removable memory device 210 when it is engaged in the memory interface assembly 211.

A portion of the memory interface assembly 211 having the opening 308 is formed with, or affixed to, a cabin facing surface 404 of the mirror housing 302, and a sidewall 314 of the memory interface assembly 211 that opposes the portion having the opening 308 is formed with, or affixed to, a cabin facing surface 408 of the substrate 312.

As shown in FIG. 4, the wire 207 couples the control module 202 to the memory interface assembly 211, such that when the removable memory device 210 is disposed in the memory interface assembly 211, the removable memory device 210 communicatively couples with the control module 202 via the wire 207, and the control module's 202 processor retrieves the unique identification from the removable memory device 210 and provides the unique identification to the antenna 204, which in turn, transmits the unique identification to the reader device when the vehicle is in communicative range thereof. The specified radio frequency may be established by the electronic toll collection system provider or other agency.

In operation, an individual in a vehicle inserts the removable memory device 210 into the opening 308 to utilize the electronic toll collection system services and may remove the memory device 210 when desired or when the memory device 210 is needed for use in a different vehicle. Alternatively, the removable memory device 210 may be housed in the memory interface assembly 211 indefinitely as desired by the subscriber. Thus, the electronic toll collection system services are portable across any vehicle having the integrated vehicle transponder integrated therein.

Turning now to FIG. 5, a plan view of a portion of a vehicle including the exemplary integrated vehicle transponder is provided. As shown in FIG. 5, each of the components of the integrated vehicle transponder (i.e., control module 202, electrical power interface 208, power converter 209, and memory interface assembly 211) is integrated within a console 550 of the vehicle with the exception of the antenna 204, which is housed in a rear-view mirror 560, and may be electrically connected to the control module 202 via wiring.

Similar to the rear-view minor assembly depicted in FIGS. 3 and 4, the integrated vehicle transponder described in FIG. 5 (with the exception of the antenna 204) may be directly formed internally with respect to the vehicle console 550 or may be disposed on a substrate and affixed to an internal portion of the vehicle console 550. Likewise, the antenna 204 may be integrally formed within a housing of the rear-view mirror 560.

The memory interface assembly 211 is configured with the vehicle console 550, such that an opening 308 is formed on a cabin facing surface 570 of the vehicle console 550 to receive the removable memory device 210.

Figure 6:
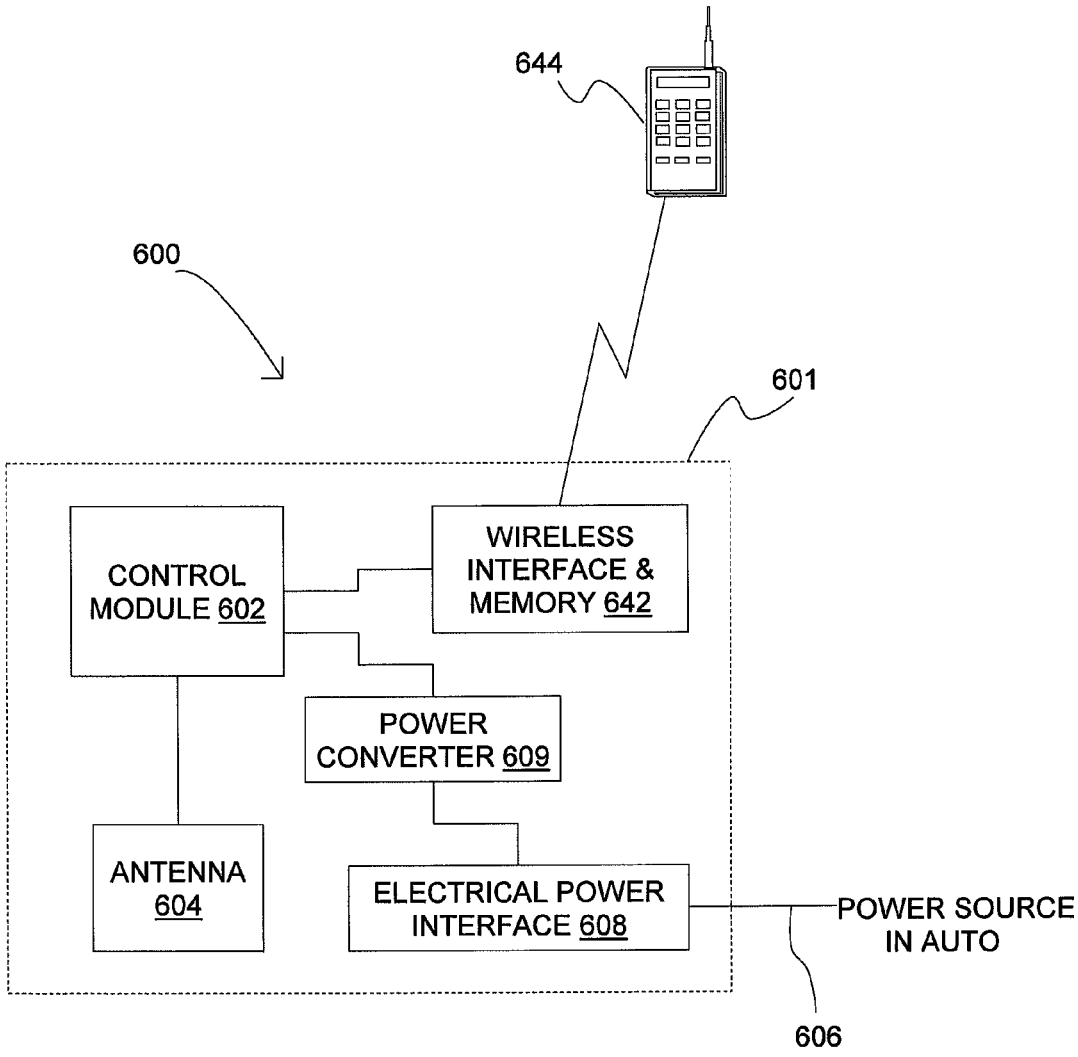
FIG. 6 depicts a block diagram of an alternative exemplary integrated automatic identification apparatus.

An alternative exemplary integrated vehicle transponder is shown in FIG. 6. The exemplary integrated vehicle transponder is configured to implement a one-time set up process using wireless communications between the integrated vehicle transponder and a mobile communication device of the user. The one-time set up process includes delivery of the subscriber's unique identification from the mobile communication device to the integrated vehicle transponder, which is then stored by the integrated vehicle transponder and transmitted to the reader device when the reader device is in range of the vehicle.

Referring now to FIG. 6, the integrated vehicle transponder for use in electronic toll collection is generally shown at 600. The integrated vehicle transponder includes a control module 602, an antenna 604, an electrical power interface 608, and a power converter 609. The control module 602, antenna 604, electrical power interface 608, and power converter 609 are formed integrally with the vehicle as shown generally at 601, and are configured substantially the same as their counterparts described in FIG. 2.

A communications component, such as an electrical wire 606 carrying power from the vehicle is connected through the electrical power interface 608 and the power converter 609 to the control module 602 for powering the same. In cases where the power from the vehicle is at the proper voltage for powering the control module 602, the power converter 609 may be omitted.

The integrated vehicle transponder of FIG. 6 also includes a wireless interface and memory 642. The wireless interface and memory 642 includes a built-in radio transmitter and receiver, along with circuitry that supports short range communication protocols, such as Bluetooth™. The memory portion of the wireless interface and memory 642 receives and stores the unique identification information of the subscriber.

Also shown in FIG. 6 is a mobile communications device 644. The mobile communications device 644 may be a smart phone that includes short-range wireless communications capabilities, such as Bluetooth™.

In operation, when a user subscribes to the electronic toll services, the user may be supplied with a unique identification that is used to identify the subscriber to the electronic toll collection services. The unique identification may be entered into the mobile communications device 644 via, e.g., a specialized mobile phone application, and when the mobile communications device 644 is in communicative range of the vehicle, the mobile communications device 644 initiates a pairing operation with the wireless interface and memory 642 through respective communications protocols. Once the mobile communications device 644 has successfully paired with the integrated vehicle transponder, the unique identification is wirelessly transmitted from the mobile communications device 644 to the wireless interface and memory 642 by way of a mobile application (software program) residing on the mobile communications device 644 and is stored therein. When the vehicle is in communicative range of a reader device at an electronic toll collection service plaza, the control module 602 retrieves the unique identification from the wireless interface and memory 642 and conveys the unique identification to the reader device via the antenna 604. Alternatively, in lieu of storing the unique subscriber identification at the removable memory device described hereinbefore, the unique subscriber identification stored at a mobile communications device 644 may be accessed, by way of a mobile application (software program) residing on the mobile communications device 644, constantly or when requested.

The exemplary integrated vehicle transponder of FIG. 6 may be configured as an integrated component of a rear-view mirror assembly similar to that depicted in FIGS. 3 and 4, or may be integrated within a vehicle console similar to that depicted in FIG. 5, so long as the antenna 604 is located within communicative range of the reader device.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. An automatic electronic toll collection (ETC) identification system, comprising:

an ETC control module configured as an integrated component of a vehicle;

an electrical power interface receptive to an electrical power signal provided from the vehicle, the electrical power interface electrically connected to the ETC control module to provide electrical power thereto, the electrical power interface configured as an integrated component of the vehicle;

a radio frequency identification (RFID) antenna electrically connected to the ETC control module, the radio frequency identification antenna responsive to the control module transmits a radio wave indicative of a unique ETC identification, the radiofrequency identification antenna configured as an integrated component of the vehicle and located to communicate the radio wave external of the vehicle; and a wireless interface communicatively coupled to the ETC control module, the wireless interface configured to receive the unique ETC identification;

a user mobile communication device comprising a software application configured to receive the unique ETC identification from an ETC service provider, to store the unique ETC identification in memory within the user mobile communication device, and to control communication of the unique ETC identification;

wherein the user mobile communication device and the wireless interface are configured to operate using a Bluetooth™ communication protocol to form a wireless network when the user mobile communication device is within communication range of the ETC control module, and wherein the ETC controller accesses the unique ETC identification stored in the user mobile communication device memory each time it is required for communication to an RFID reader device of the ETC identification system for toll collection, and does not store the unique ETC identification within the ETC controller.

2. The automatic ETC identification system of claim 1 wherein the radio frequency identification antenna is integrally formed in a rear view mirror assembly of the vehicle.

3. The automatic ETC identification system of claim 1 wherein at least a portion of the rear-view mirror assembly is formed of non-metallic material to provide a communication pathway between the radio frequency identification antenna and a reader device.

* * * * *